US007204236B2

(12) United States Patent
Ma et al.

(10) Patent No.: US 7,204,236 B2
(45) Date of Patent: Apr. 17, 2007

(54) CALIBRATION OF MODEL-BASED FUEL CONTROL WITH FUEL DYNAMICS COMPENSATION FOR ENGINE START AND CRANK TO RUN TRANSITION

(75) Inventors: Qi Ma, Farmington Hills, MI (US); Stephen Yurkovich, Columbus, OH (US); Kenneth P. Dudek, Rochester Hills, MI (US); Stephen K. Fulcher, Clovis, NM (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/333,082

(22) Filed: Jan. 17, 2006

(65) Prior Publication Data

US 2006/0249122 A1 Nov. 9, 2006

Related U.S. Application Data

(60) Provisional application No. 60/677,771, filed on May 4, 2005.

(51) Int. Cl.
*F02D 41/06* (2006.01)
*F02M 51/06* (2006.01)

(52) U.S. Cl. ..... 123/491; 123/435; 701/113

(58) Field of Classification Search ..... 123/491, 123/299–300, 305, 435, 472, 480, 494; 701/103–105, 701/113–115; 73/118.1, 117.3, 119 A
See application file for complete search history.

(56) References Cited

U.S. PATENT DOCUMENTS

2006/0243039 A1* 11/2006 Ma et al. ..... 73/118.2
2006/0243255 A1* 11/2006 Ma et al. ..... 123/491

FOREIGN PATENT DOCUMENTS

DE 10020448 10/2001

* cited by examiner

*Primary Examiner*—Hai Huynh
(74) *Attorney, Agent, or Firm*—Christopher DeVries

(57) ABSTRACT

A fuel control system for regulating fuel to cylinders of an internal combustion engine during an engine start and crank-to-run transition includes a first module that determines a raw injected fuel mass based on a utilized fuel fraction (UFF) model and a nominal fuel dynamics (NFD) and a second module that regulates fueling to a cylinder of the engine based on the raw injected fuel mass until a combustion event of the cylinder. Each of the UFF and NFD models is calibrated based on data from a plurality of test starts-that are based on a pre-defined test schedule.

24 Claims, 11 Drawing Sheets

CALIBRATION OF MODEL-BASED FUEL CONTROL WITH FUEL DYNAMICS COMPENSATION FOR ENGINE START AND CRANK TO RUN TRANSITION

CROSS-REFERENCE TO RELATED APPLICATIONS

This application claims the benefit of U.S. Provisional Application No. 60/677,771, filed on May 4, 2005. The disclosure of the above application is incorporated herein by reference.

FIELD OF THE INVENTION

The present invention relates to internal combustion engines, and more particularly to calibrating fuel control models that regulate fuel to an engine during an engine start and crank-to-run transition.

BACKGROUND OF THE INVENTION

Internal combustion engines combust a fuel and air mixture within cylinders driving pistons to produce drive torque. During engine start-up, the engine operates in transitional modes including key-on, crank, crank-to-run and run. The key-on mode initiates the start-up process and the engine is cranked (i.e., driven by a starter motor) during the crank mode. As the engine is fueled and the initial ignition event occurs, engine operation transitions to the crank-to-run mode. Eventually, when all cylinders are firing and the engine speed is above a threshold level, the engine transitions to the run mode.

Accurate control of fueling plays an important roll in enabling rapid engine start and reduced variation in start time (i.e., the time it takes to transition to the run mode) during the transitional engine start-up. Traditional transitional fuel control systems fail to adequately account for lost fuel and fail to detect and ameliorate misfires and poor-starts during the transitional phases. Further, traditional fuel control systems are not sufficiently robust and require significant calibration effort.

SUMMARY OF THE INVENTION

Accordingly, the present invention provides a fuel control system for regulating fuel to cylinders of an internal combustion engine during an engine start and crank-to-run transition. The fuel control system includes a first module that determines a raw injected fuel mass based on a utilized fuel fraction (UFF) model and a nominal fuel dynamics (NFD) model and a second module that regulates fueling to a cylinder of the engine based on the raw injected fuel mass until a combustion event of the cylinder. Each of the UFF and NFD models is calibrated based on data from a plurality of test starts that are based on a pre-defined test schedule.

In one feature, calibration of the UFF and NFD models occurs simultaneously.

In other features, the third module determines an average raw injected fuel mass and an average measured burned fuel mass over a predefined number of engine cycles. The UFF model is calibrated based on the average raw injected fuel mass and the average measured burned fuel mass. The average raw injected fuel mass and the average measured burned fuel mass are determined at a plurality of engine coolant temperatures.

In still other features, the third module calibrates the NFD model and a shaping parameter at fixed engine coolant temperature intervals. The shaping parameter is calibrated based on an initial shaping parameter value, a corrected fuel mass, a UFF value and a raw injected fuel mass. The shaping parameter is calibrated based on a vaporization rate and an averaged ratio that is determined based on a corrected fuel mass and a measured burned fuel mass over a predefined number of engine cycles.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
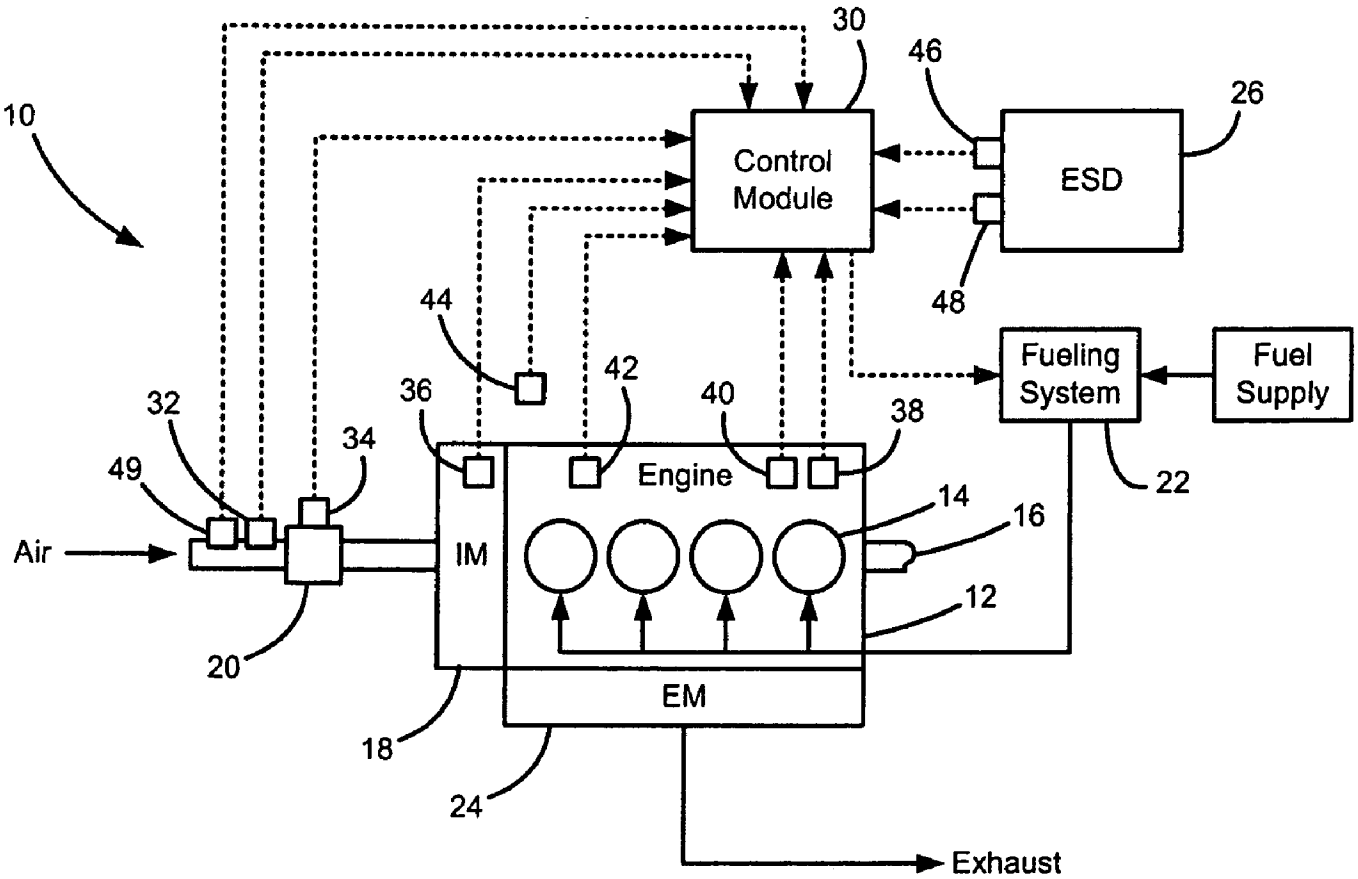
FIG. 1 is a schematic illustration of an exemplary engine system regulated using the transitional fuel control of the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an exemplary vehicle system 10 is schematically illustrated. The vehicle system includes an engine 12 that combusts a fuel and air mixture within cylinders 14 to drive pistons slidably disposed within the cylinders 14. The pistons drive a crankshaft 16 to produce drive torque. Air is drawn into an intake manifold 18 of the engine 12 through a throttle 20. The air is distributed to the cylinders 14 and is mixed with fuel from a fueling system 22. The air and fuel mixture is ignited or sparked to initiate combustion. Exhaust produced by combustion is exhausted from the cylinders 14 through an exhaust manifold 24. An energy storage device (ESD) 26 provides electrical energy to various components of the vehicle system. For example, the ESD 26 provides electrical energy to produce spark and provides electrical energy to rotatably drive the crankshaft 16 during engine start-up.

A control module 30 regulates overall operation of the vehicle system 10. The control module 30 is responsive to a plurality of signals generated by various sensors, as described in further detail below. The control module 30 regulates fuel flow to the individual cylinders based on the transitional fuel control of the present invention, during transitions across a key-on mode, a crank mode, a crank-to-run mode and a run mode. More specifically, during engine start-up, the initial mode is the key-on mode, where a driver turns the ignition key to initiate engine start-up. The crank mode follows the key-on mode and is the period during which a starter motor (not illustrated) rotatably drives the pistons to enable air processing in the cylinders 14. The crank-to-run mode is the period during which the initial ignition event occurs prior to normal engine operation in the run mode.

The vehicle system 10 includes a mass air flow (MAF) sensor 32 that monitors the air flow rate through the throttle 20. A throttle position sensor 34 is responsive to a position of a throttle plate (not shown) and generates a throttle position signal (TPS). An intake manifold pressure sensor 36 generates a manifold absolute pressure (MAP) signal and an engine speed sensor 38 generates and engine speed (RPM) signal. An engine oil temperature sensor 40 generates an engine oil temperature ($T_{OIL}$) signal and an engine coolant temperature sensor 42 generates an engine coolant temperature (ECT) signal. A pressure sensor 44 is responsive to the atmospheric pressure and generates a barometric pressure ($P_{BARO}$) signal. Current and voltage sensors 46,48, respectively, generate current and voltage signals of the ESD 26. An intake air temperature (IAT) sensor 49 generates an IAT signal.

The transitional fuel control of the present invention calculates a raw injected fuel value (RINJ) to be injected into each cylinder during transition from engine start to crank-to-run. More specifically, the transitional fuel control predicts cylinder air charge (GPO) and determines RINJ based on GPO. The transitional fuel control implements a plurality of functions including, but not limited to: crank GPO prediction, crank-to-run GPO prediction, run GPO prediction, a scheduled GPO filter, misfire detection, poor-start detection, poor-start recovery detection, misfire/poor-start GPO prediction, transition rules, utilized fuel fraction (UFF) calculation, nominal fuel dynamics model and control, a fuel dynamics control strategy and individual cylinder fuel prediction scheduling and command scheduling. It is assumed that the most accurate way to estimate the true GPO is using bottom dead center (BDC) MAP data. Due to hardware constraints, the closest MAP measurement is sampled at a specified cylinder event. An exemplary cylinder event for an exemplary 4 cylinder engine is at approximately 60°–75° degrees crank angle (CA) before intake BDC. There is a specific CA value between cylinder events. For example, for the exemplary 4 cylinder engine, there is 180° CA between events.

The crank GPO prediction consists of 1st, 2nd and 3rd step ahead GPO predictions, with a measurement update. The crank GPO prediction is used to predict GPO for those cylinders that will ingest their air charge during operation in the crank mode. The following equations are associated with the crank GPO prediction:

$$GPO_{k+3|k}=\alpha_{CRK}GPO_{k+2|k}+(1-\alpha_{CRK})GPO_{k+1|k} \quad (1)$$

$$GPO_{k+2|k}=\alpha_{CRK}GPO_{k+1|k}+(1-\alpha_{CRK})GPO_{k|k} \quad (2)$$

$$GPO_{k+1|k}=\alpha_{CRK}GPO_{k|k}+(1-\alpha_{CRK})GPO_{k+1|k} \quad (3)$$

$$GPO_{k|k}=GPO_{k|k-1}+KG(GPO_k-GPO_{k|k-1}) \quad (4)$$

Equation 1 is the 3rd step ahead prediction, Equation 2 is the 2nd step ahead prediction, Equation 3 is the 1st step ahead prediction and Equation 4 is a measurement update. $\alpha_{CRK}$ is a single fixed number for all engine start conditions and KG denotes a steady-state Kalman filter gain. Because the crank GPO predictor only runs for a short period of time (e.g., only the first three engine events for the exemplary 1–4 engine), $\alpha_{CRK}$ is tuned manually. The subscript k|k−1 denotes the value at current event k using information up through previous event k−1, k|k denotes the value at current event k using information up through current event k, k+1|k denotes the value up through future event k+1 using information up through current event k and so on.

$GPO_k$ is calculated based on the following equation:

$$GPO_k=\alpha_{CRK-VE}VE_{CRK}MAP_k/IAT_k \quad (5)$$

where $VE_{CRK}$ is the volumetric efficiency at the cranking speed, which is calculated from the geometry of the piston and cylinder head using a known compression ratio, $\alpha_{CRK-VE}$ is a scaling coefficient used to match the units of $VE_{CRK}$ and $MAP_k/IAT_k$.

The crank-to-run GPO prediction also includes 1st, 2nd and 3rd step ahead GPO predictions and measurement update. As explained in further detail below, there is a transitional period during which the crank GPO prediction and the crank-to-run GPO prediction function concurrently. Once wholly in the crank-to-run mode, the crank-to-run GPO prediction is used alone. The crank-to-run GPO prediction is used to predict GPO for those cylinders that will ingest their air charge during operation in the crank-to-run mode. The equations associated with the crank-to-run GPO prediction are provided as:

$$GPO_{k+3|k}=\alpha_{CTR}GPO_{k+2|k} \quad (6)$$

$$GPO_{k+2|k}=\alpha_{CTR}GPO_{k+1|k} \quad (7)$$

$$GPO_{k+1|k}=\alpha_{CTR}GPO_{k|k} \quad (8)$$

$$GPO_{k|k}=GPO_{k|k-1}+KG(GPO_k-GPO_{k|k-1}) \quad (9)$$

where Equation 6 is the 3rd step ahead prediction, Equation 7 is the 2nd step ahead prediction, Equation 8 is the 1st step ahead prediction and Equation 9 is the measurement update.

The predictor coefficient, $\alpha_{CTR}$, where the subscript CTR denotes crank-to-run condition, is a linear spline function of TPS and engine RPM signals and is provided as:

$$\alpha_{CTR} = c_0 + \sum_{i=1}^{n} a_i \times UTPS(i) + \sum_{j=1}^{m} b_j \times URPM(j) \tag{10}$$

where $$UTPS(i) = \begin{cases} 0 & \text{if } TPS \le TPS_i \\ TPS - TPS_i & \text{otherwise} \end{cases} \tag{11}$$

and $$URPM(j) = \begin{cases} 0 & \text{if } RPM \le RPM_j \\ RPM - RPM_j & \text{otherwise} \end{cases} \tag{12}$$

The following definitions are also provided:

$$R_{i,j}=\{[TPS_i,TPS_{i+1}),[\mathrm{RPM}_j,\mathrm{RPM}_{j+1})\} \quad i=1,2,\ldots n-1 \; j=1,2,\ldots m-1 \tag{13}$$

$$R_{n,j}=\{[TPS_n,\infty),[\mathrm{RPM}_j,\mathrm{RPM}_{j+1})\} \; j=1,2,\ldots m-1 \tag{14}$$

$$R_{i,m}=\{[TPS_i,TPS_{i+1}),[\mathrm{RPM}_m,\infty)\} \; i=1,2,\ldots n-1 \tag{15}$$

$$\mathrm{R}_{n,m}=\{[TPS_n,\infty),[\mathrm{RPM}_m,\infty)\} \tag{16}$$

where (TPS,RPM)$\epsilon$ $R_{i,j}$, $\alpha_{CTR}$ can be rewritten as:

$$\alpha_{CTR}=\delta_0+\delta_1\times TPS+\delta_2\times \mathrm{RPM} \tag{17}$$

and where:

$$\delta_0 = c_0 - \sum_{k=1}^{i} a_k \times TPS_k - \sum_{k=1}^{j} b_k \times RPM_k \tag{18}$$

$$\delta_1 = \sum_{k=1}^{i} a_k \tag{19}$$

$$\delta_2 = \sum_{k=1}^{j} b_k \tag{20}$$

Exemplary values of $TPS_i$ and $RPM_J$ are (5, 15, 20, 30, ∞) and (600, 1200, 1800, ∞), respectively.

In Equation 9, $GPO_k$ is calculated based on the following equation:

$$GPO_k=\alpha_{RUN-VE}VE_{RUN}(MAP_k, \mathrm{RPM}_k)MAP_k/IAT_k \tag{21}$$

where $VE_{RUN}(.)$ is the volumetric efficiency at the normal or run operating condition and is determined based on MAP and RPM, and $\alpha_{Run-VE}$ is a scaling coefficient used to match the units of $VE_{RUN}(.)$ and $MAP_k/IAT_k$.

The run GPO prediction includes 1st, 2nd and 3rd step ahead GPO predictions and a measurement update. The run GPO prediction is used during the run mode. The equations associated with the run GPO prediction are provided as:

$$GPO_{k+3|k}=\alpha_{RUN}GPO_{k+2|k}+U(TPS,GPC) \tag{22}$$

$$GPO_{k+2|k}=\alpha_{RUN}GPO_{k+1|k}+U(TPS,GPC) \tag{23}$$

$$GPO_{k+1|k}=\alpha_{RUN}GPO_{k|k}+U(TPS,GPC) \tag{24}$$

$$GPO_{k|k}=GPO_{k|k-1}+KG(GPO_k-GPO_{k|k-1}) \tag{25}$$

where Equation 22 is the 3rd step ahead prediction, Equation 23 is the 2nd step ahead prediction, Equation 24 is the 1st step ahead prediction and Equation 25 is the measurement update. The input function U(TPS,GPC) is a function of TPS and the cylinder air charge as measured at the throttle (GPC) based on MAF, and is provided as:

$$U(TPS, GPC) = \sum_{i=1}^{3} \beta_i TPS_{k-i+1} + \sum_{j=1}^{3} \gamma_j GPC_{k-j+1} \tag{26}$$

The parameter constraints of the run GPO predictor and the input function are $\beta_1+\beta_2+\beta_3=0$ and $1-\alpha_{RUN}=\gamma_1+\gamma_2+\gamma_3$ where $\alpha_{RUN}$ is a single fixed number. In Equation 25, $GPO_k$ is calculated as follows:

$$GPO_k=\alpha_{RUN-VE}VE_{RUN}(MAP_k,\mathrm{RPM}_k)MAP_k \tag{27}$$

Figure 2:
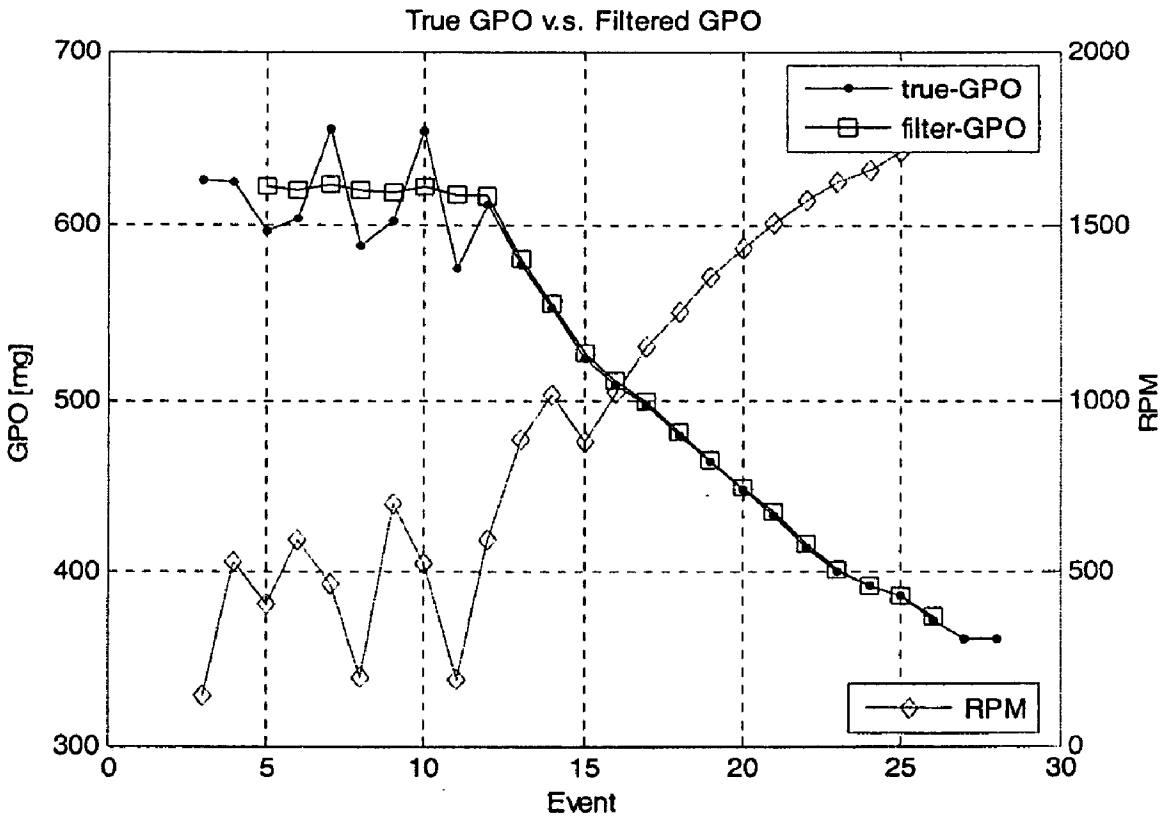
FIG. 2 is a graph illustrating an exemplary actual cylinder air charge (GPO) versus an exemplary filtered GPO during an anomalous engine start.

Referring now to FIG. 2, under anomalous engine starts (e.g., misfire and/or poor start conditions), the GPO Referring now to FIG. 2, under anomalous engine starts (e.g., misfire and/or poor start conditions), the GPO measurement can have undesired fluctuations. This may cause the GPO prediction to exhibit undesired behavior. The exemplary data trace of a poor start is illustrated in FIG. 2. The filtered GPO is better behaved (i.e., has less fluctuation) and is therefore more useful than the measured GPO in GPO prediction. The GPO filter scheduling is based on the firing behavior of the engine. More specifically, for normal engine starts (i.e., normal mode) the filtered GPO ($GPOF_k$) is provided as:

$$GPOF_k=0.1GPOF_{k-1}+0.9GPO_k \tag{28}$$

For anomalous engine starts (including misfire and/or poor start) $GPOF_k$ is provided as:

$$GPOF_k=0.9GPOF_{k-1}+0.1GPO_k \tag{29}$$

Because the fast GPO decay starts from a specific event (e.g., Event 4 for the exemplary 1–4 engine), the GPO filter is only activated from that event forward. Therefore, from that event forward, $GPO_k$ appearing in all prediction equations described above are replaced by $GPOF_k$. It is appreciated that the values 0.1 and 0.9 are merely exemplary in nature.

Under normal engine starts, the time constant of the GPO filter is 0.1 and does not play a role in filtering the true measured GPO. In this case, the benefit of using filtered GPO is not obvious. However, in the case of anomalous engine starts, the time constant of the GPO filter can be as large as 0.9. This scheme provides a safety-net implemented in the overall GPO prediction scheme. When the engine recovers from misfire or poor start, the GPO filter is switched to normal operating mode.

Engine misfire detection is performed based on monitoring an RPM difference across events, between which the first firing occurs. For the exemplary 1–4 engine having known cam position, the first firing occurs between Event 3 and Event 4. Therefore, misfire can be detected on Event 4. The detection rule for the misfire is defined as follows:

If $\Delta\mathrm{RPM}=(\mathrm{RPM}_4-\mathrm{RPM}_3)<\Delta\mathrm{RPM}_{1st\text{-}fire}$, misfire is detected.

where $\Delta\mathrm{RPM}_{1st\text{-}fire}$ (i.e., change in RPM due to first fire) is a calibratable number (e.g., approximately 200 RPM). For engines with more than four cylinders, the detection rule can be adjusted accordingly. The notation $RPM_k$ refers to the RPM at event k.

Poor start can be detected based on a threshold RPM after the $2^{nd}$ combustion event. Under normal conditions for the exemplary 1–4 engine, the 2nd combustion occurs between Event 4 and Event 5 and is capable of bringing the engine speed to a value greater than a threshold RPM (e.g., 700 RPM). Therefore, the rule for poor-start detection is defined as follows:

If $RPM_{k\geqq 5}\leqq 700$, poor start is detected.

If the engine is operating in poor-start mode and $RPM_k\geqq 1400$, poor-start recovery is detected. The RPM threshold for poor-start recovery can be defined at the instant when both $RPM_k\geqq 1400$and the first reliable reading of GPC is available. It is appreciated that the threshold RPM values provided herein are merely exemplary in nature. When poor-start recovery is detected, the GPO filter is switched to normal mode accordingly and the GPO prediction is made using the run GPO predictor.

If the engine is operating in the misfire mode, the misfire GPO prediction replaces the crank-to-run GPO prediction. The misfire GPO prediction implements the following equations:

$$GPO_{k+3|k}=\alpha_{MIS}{}^3GPO_{k|k} \tag{30}$$

$$GPO_{k+2|k}=\alpha_{MIS}{}^2GPO_{k|k} \tag{31}$$

$$GPO_{k+1|k}=\alpha_{MIS}GPO_{k|k} \tag{32}$$

$$GPO_{k|k}=GPO_{k|k-1}+KG(GPO_k-GPO_{k|k-1}) \tag{33}$$

where Equation 30 is the $3^{rd}$ step ahead prediction, Equation 31 is the $2^{nd}$ step ahead prediction, Equation 32 is the $1^{st}$ step ahead prediction and Equation 33 is the measurement update and exemplary values $\alpha_{MIS}=1$ and KG=0.8 are provided. It is appreciated, however, that these values may vary based on engine specific parameters.

If the engine is operating in the poor-start mode, the poor-start GPO prediction replaces the crank-to-run prediction. The poor-start GPO prediction implements the following equations:

$$GPO_{k+3|k}=\alpha_{PS}{}^3GPO_{k|k} \tag{34}$$

$$GPO_{k+2|k}=\alpha_{PS}{}^2GPO_{k|k} \tag{35}$$

$$GPO_{k+1|k}=\alpha_{PS}GPO_{k|k} \tag{36}$$

$$GPO_{k|k}=GPO_{k|k-1}+KG(GPO_k-GPO_{k|k-1}) \tag{37}$$

where Equation 34 is the $3^{rd}$ step ahead prediction, Equation 35 is the $2^{nd}$ step ahead prediction, Equation 36 is the $1^{st}$ step ahead prediction and Equation 37 is the measurement update, and exemplary values of $\alpha_{PS}=0.98$ and KG=0.8 are provided. It is appreciated, however, that these values may vary based on engine specific parameters.

For the exemplary 4-cylinder engine, the rules to define the transition between modes are summarized below. With a known cam position, Event 4 is the default event for the transition from the crank mode to the crank-to-run mode. At Event 4, if the change in RPM is less than a calibratable number (e.g., 200 RPM), weak-fire is detected, the weak-fire GPO prediction is activated and the anomalous GPO filter and the weak-fire GPO prediction are used. At Event 5, if engine speed is less than a calibratable number (e.g., 700 RPM), poor-start is predicted and the poor start GPO prediction is activated. Concurrently, the anomalous GPO filter is activated. Otherwise, the normal GPO filter and the crank-to-run GPO prediction are activated. If the engine speed passes the calibratable RPM threshold (e.g., 1400 RPM), either from a poor-start recovery mode or a normal start mode, the prediction scheme switches to the run GPO prediction. For engines with more than 4 cylinders, similar but modified rules are applied.

Figure 3:
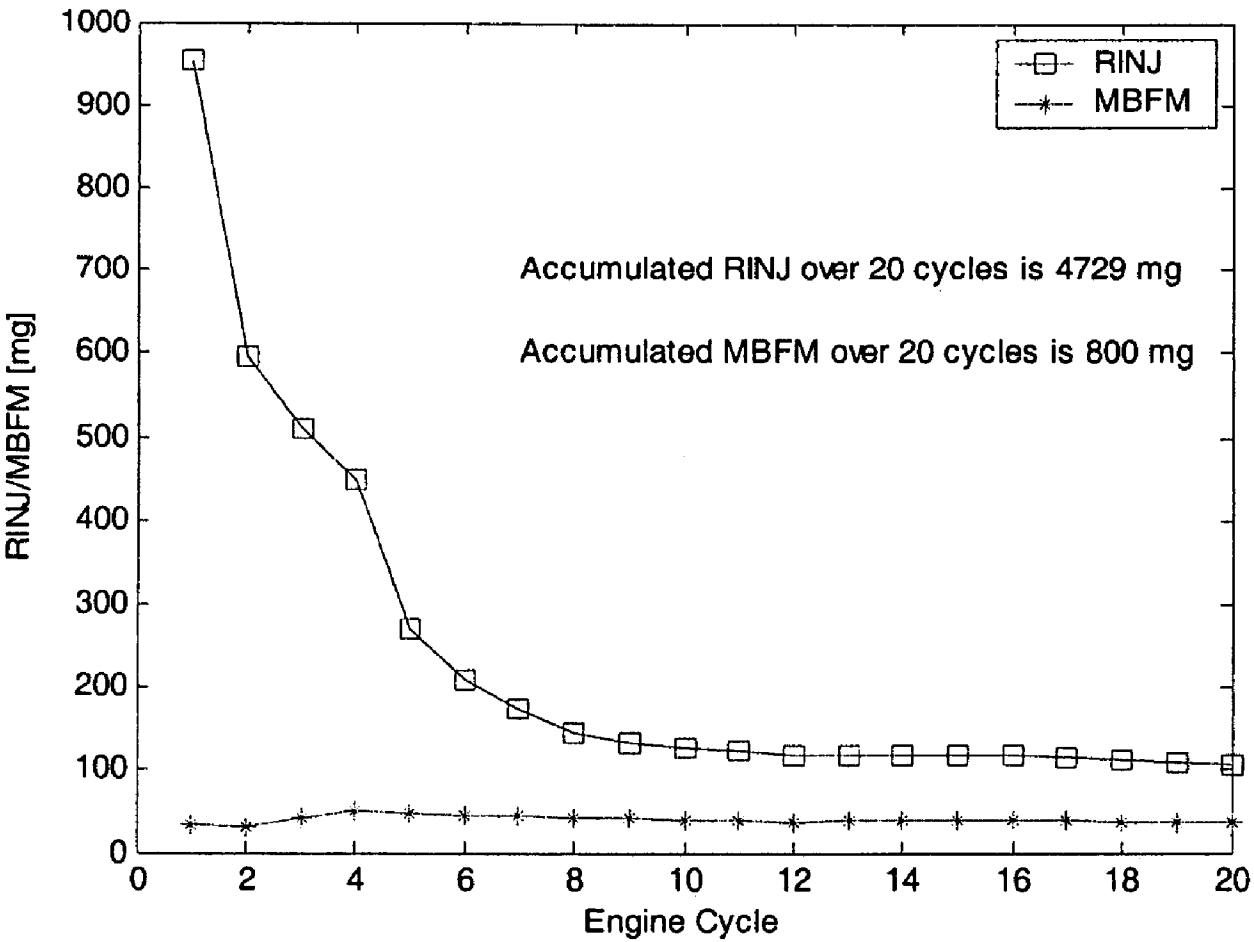
FIG. 3 is a graph illustrating an exemplary raw injected fuel mass (RINJ) and an exemplary measured burned fuel mass (MBFM) over a plurality of engine cycles.

Referring now to FIG. 3, a utilized fuel fraction (UFF) function of the transitional fuel control will be described in detail. The UFF is the percentage of fuel actually burned in the current combustion event and is based on experimental observations. More specifically, the UFF is a fraction of the raw injected fuel mass (RINJ) to the measured burned fuel mass (MBFM). There is an amount of RINJ which does not participate in the combustion process. The effect of such a phenomenon is illustrated in FIG. 3 where the total amount of RINJ does not show up in the exhaust measurement and an effect of diminishing return is observed. This incomplete fuel utilization phenomenon indicates that the utilization rate is not a constant number and is a function of RINJ.

The transitional fuel control of the present invention models this crucial nonlinearity by separating the overall fuel dynamics into two cascaded subsystems: nonlinear input (RINJ) dependent UFF and a unity-gained nominal fuel dynamics (NFD) function.

The input (RINJ) dependent UFF function is provided as:

$$CINJ(k) = UFF_{SS}\left(1-\frac{2}{\pi}\arctan\left(\frac{RINJ(k)}{\gamma(ECT)}\right)\right)RINJ(k) \tag{38}$$

where CINJ is the corrected amount of fuel mass that is injected by accounting for the UFF. The sub-script SS indicates the cycle at which the engine air dynamics achieve a steady/state. Although an exemplary value of SS equal to 20 (i.e., the $20^{th}$ cycle), it is appreciated that this value can vary based on engine specific parameters. The UFF function is defined as follows:

$$UFF = UFF_{20}\left(1-\frac{2}{\pi}\arctan\left(\frac{RINJ(k)}{\gamma(ECT)}\right)\right) \tag{39}$$

In the above expressions, $UFF_{20}$ denotes the UFF calculated at the exemplary cycle 20. The parameter γ(ECT) is used to characterize a shape that meets the correction requirement to capture the diminishing return effect. This single ECT-based parameter simplifies the calibration process and permits a robust parameter estimate when data richness is an issue. The magnitude of γ(ECT) is in the same range of the first indexed RINJ (RINJ(1)) during a normal engine start for a given, fixed ECT. γ(ECT) is therefore viewed as a weighting parameter for RINJ correction in the first few engine cycles.

The forward, mass conservative or unity gained nominal fuel dynamics (NFD) function of the transitional fuel control is represented using the following auto-regressive moving average (ARMA) equation:

$$y(k)=-\beta_1y(k-1)+\alpha_0u(k)+\alpha_1u(k-1) \tag{40}$$

where y(k) denotes the MBFM and u(k) indicates CINJ. Equation 40 is subject to a unity constraint: $1+\beta_1=\alpha_0+\alpha_1$. Although the NFD model structure is a first order linear model, the model parameters are a function of ECT. In addition, under a normal engine start, parameters $\alpha_0$, $\alpha_1$ and $\beta_1$ are also mildly influenced by the RPM and MAP. However, under anomalous engine starts, control using such a model structure and parameter setup (i.e., capturing the MAP and RPM effect) can result in inappropriate fuel dynamics compensation due to insufficient accuracy of MAP and RPM predictions. Therefore, the $\alpha_0$, $\alpha_1$ and $\beta_1$, parameters are functions of ECT only. When used in transition fuel control, Equation 40 is inverted to provide:

$$u(k) = -\frac{\alpha_1}{\alpha_0}u(k-1) + \frac{1}{\alpha_0}y(k) + \frac{\beta_1}{\alpha_0}y(k-1) \tag{41}$$

where y(k) is the desired in-cylinder burned fuel mass (i.e., commanded fuel) and u(k) is the nominal dynamics adjusted fuel command.

Figure 4:
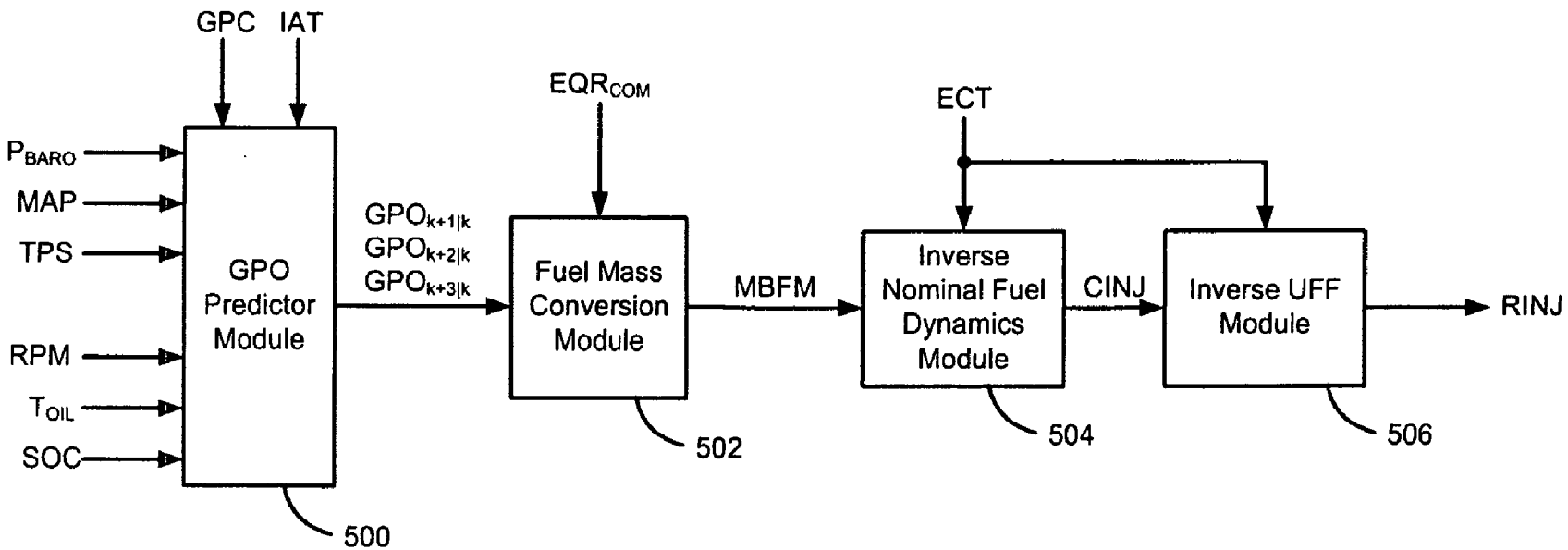
FIG. 4 is a signal flow diagram illustrating exemplary modules that execute the transitional fuel control of the present invention.

Referring now to FIG. 4, exemplary modules that execute the transitional fuel control are illustrated. Fuel control generally includes the GPO prediction (i.e., multi-step GPO predictor for crank, crank-to-run and run), conversion of the predicted GPO and the commanded equivalence ratio (EQR) trajectory to the fuel mass command, nominal inverse fuel dynamics scheduled based on ECT and inverse UFF function scheduled based on ECT. $EQR_{COM}$ is determined as the ratio of the commanded fuel to air ratio to the stoichiometric fuel to air ratio and is used to negate differences in fuel compositions and to provide robust fueling to the engine in cold start conditions. The stoichiometric fuel to air ratio is the specific fuel to air ratio at which the hydrocarbon fuel is completely oxidized. The modules include, but are not limited to, a GPO predictor module 500, a fuel mass conversion module 502, an inverse nominal fuel dynamics module 504 and an inverse UFF module 506.

The GPO predictor module 500 generates $GPO_{k+1|k}$, $GPO_{k+2|k}$ and $GPO_{k+3|k}$ based on $P_{BARO}$, MAP, TPS, RPM, $T_{OIL}$, SOC, GPC and IAT. The particular prediction model or models used depend on the current event number and the engine mode (e.g., misfire and poor-start) and include crank GPO prediction, crank-to-run GPO prediction and run GPO prediction, misfire GPO prediction and poor-start GPO prediction. The fuel mass conversion module 502 determines MBFM based on the GPO values and $EQR_{COM}$. The inverse nominal fuel dynamics module 504 determines CINJ based on MBFM and ECT. The inverse UFF module 506 determines RINJ based on CINJ and ECT. The cylinders are fueled based on the respective RINJs.

Figure 5:
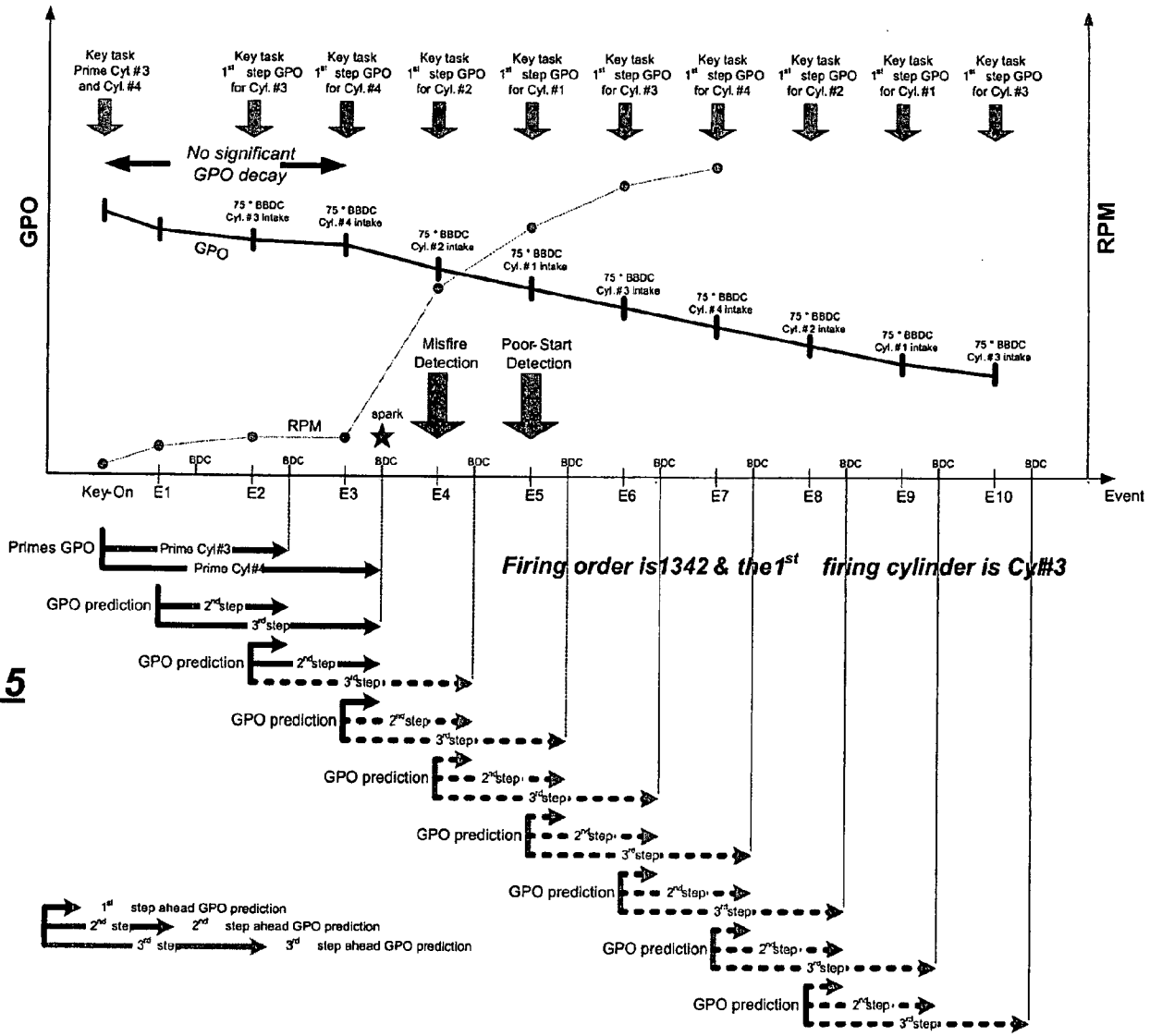
FIG. 5 is a graph illustrating an exemplary event resolved GPO prediction scheme according to the present invention.

Referring now to FIG. 5, an event resolved GPO prediction scheduling scheme is graphically illustrated for the exemplary 4 cylinder engine. It is appreciated that the GPO prediction scheduling scheme can be adjusted for application to engines having a differing number of cylinders. It is also appreciated that the graph of FIG. 5 is for the exemplary engine in an exemplary starting position where cylinder #3 is the first cylinder that is able to be fired. The transitional fuel control or the present invention is applicable to other starting positions (e.g., cylinder #1 is the first cylinder that is able to be fired).

A key-on event initiates cranking of the engine and only two cylinders are primed (e.g., for a 4 cylinder engine) to avoid open valve injection in case of a mis-synchronization. Cylinder #1 cannot be fueled due to the open intake valve. The primed fuel shots are calculated using the crank GPO prediction. At the first event (E1), where cylinder #1 is at 75° CA before BDC intake and no fuel is injected, a mis-synchronization correction is performed and only the crank GPO prediction is operating. Also at E1, a $2^{nd}$ step ahead prediction of GPO for cylinder #3 and a $3^{rd}$ step ahead prediction of GPO for cylinder #4 are performed. Respective RINJs are determined based on the $2^{nd}$ and $3^{rd}$ step ahead GPOs and Cylinders #3 and #4 are fueled based on the RINJs.

At the second event (E2), cylinder #3 is at 75° CA before BDC and the $1^{st}$ step ahead GPO prediction and fuel command are made. The crank GPO prediction and the crank-to-run GPO prediction are operating simultaneously. More specifically, at E2, a $1^{st}$ step ahead prediction of GPO for cylinder #3 and a $2^{nd}$ step ahead prediction of GPO for cylinder #4 are determined using the crank GPO prediction (see solid arrows). A $3^{rd}$ step ahead prediction of GPO for cylinder #2 is determined using the crank-to-run GPO prediction (see phantom arrow). Respective RINJs are calculated based on the GPO predictions and cylinders #3, #4 and #2 are fueled based on the RINJs through to the next event.

At the third event, cylinder #4 is at 75° CA before BDC, the crank GPO prediction and the crank-to-run GPO prediction are operating simultaneously and the fuel dynamics initial condition of cylinder #3 is no longer zero and must be accounted for in the next fueling event. More specifically, at E3, a $1^{st}$ step ahead prediction of GPO for cylinder #4 is determined using the crank GPO prediction (see solid arrow). A $2^{nd}$ step ahead GPO prediction for cylinder #2 and a $3^{rd}$ step ahead GPO prediction for cylinder #1 are determined using the crank-to-run prediction (see phantom arrows). Respective RINJs are calculated based on the GPO predictions and cylinders #4, #2 and #1 are fueled based on the RINJs through to the next event.

At the fourth event (E4), cylinder #2 is at 75° CA before BDC, misfire detection is performed and the fuel dynamics initial condition of cylinder #4 is no longer zero and must be accounted for in the next fueling event. If there is no misfire detected, a $1^{st}$ step ahead GPO prediction for cylinder #2, a $2^{nd}$ step ahead GPO prediction for cylinder #1 and a $3^{rd}$ step ahead GPO prediction for cylinder #3 are determined using the crank-to-run prediction (see phantom arrows). If there a misfire is detected, a $1^{st}$ step ahead GPO prediction for cylinder #2, a $2^{nd}$ step ahead GPO prediction for cylinder #1 and a $3^{rd}$ step ahead GPO prediction for cylinder #3 are determined using the misfire prediction. Respective RINJs are calculated based on the GPO predictions and cylinders #2, #1 and #3 are fueled based on the RINJs through to the next event.

At the fifth event (E5), cylinder #1 is at 75° CA before BDC, poor start detection is performed and the fuel dynamics initial condition of cylinder #2 is no longer zero and must be accounted for in the next fueling event. If poor-start is not detected, a $1^{st}$ step ahead GPO prediction for cylinder #1, a $2^{nd}$ step ahead GPO prediction for cylinder #3 and a $3^{rd}$ step ahead GPO prediction for cylinder #2 are determined using the run prediction. If poor-start is detected, a $1^{st}$ step ahead GPO prediction for cylinder #1, a $2^{nd}$ step ahead GPO prediction for cylinder #3 and a $3^{rd}$ step ahead GPO prediction for cylinder #2 are determined using the poor-start prediction. Respective RINJs are calculated based on the predictions and cylinders #1, #3 and #4 are fueled based on the RINJs through to the next event. The subsequent events (E6–En) are similar, alternating cylinders based on the firing order (e.g., 1342 with cylinder #3 firing first for the exemplary 4 cylinder engine). When the engine speed is stable and is greater than 1400 RPM, the run GPO prediction is used.

A calibration process for the UFF and NFD functions of the transitional fuel control is provided. A state variable representation of the forward (i.e., non-inverted) NFD is provided as:

$$\begin{cases} m_{dep}(k) = (1-\tau)m_{dep}(k-1) + (1-X)u(k) \\ m_{cyl}(k) = \tau m_{dep}(k-1) + Xu(k) \end{cases} \quad (42)$$

The system output is $m_{cyl}(k)$, which corresponds toy(k)in the ARMA formulation and the system input is the UFF-corrected injected fuel mass (CINJ), which corresponds to u(k). Interpreting the state variable $m_{dep}(k)$ in the context of the known discrete τ-X fuel dynamics model, τ can be viewed as the vaporization rate and X as the fraction of direct feed-through control input. The construction of the state variable equivalent of the τ-X model satisfies the unit-gain property, and can be written in the ARMA form as:

$$y(k)-(1-\tau)y(k-1)=Xu(k)-(X-\tau)u(k-1) \quad (43)$$

It can be noted that $\alpha_0$ correlates to X, $\alpha_1$ correlates to −(X−τ), and $\beta_1$ correlates to −(1−τ). Both the state variable model and ARMA model will be used to describe the calibration process of the present invention.

In the calibration process of the present invention, mass conservation refers to the unit-gain, asymptotically stable characteristics of a dynamic process. If the initial condition of an asymptotically stable, unit-gain dynamical system is identically zero, then the energy stored is the difference between the input energy and the output energy. In the context of the state variable representation of the NFD function, the following statement is valid when the initial condition $m_{dep}(\mathbf{0})$ is identically zero:

$$m_{dep}(T) = \sum_{k=1}^{T} u(k) - \sum_{k=1}^{T} m_{cyl}(k) \quad (44)$$

In the case of an exemplary 4 cylinder engine with well-designed engine start and crank-to-run fuel control, the input (u(k)) and the output ($m_{cyl}(k)$) will steadily approach each other starting around the $16^{th}$ engine cycle.

Therefore, $m_{cyl}(16 \leqq k \leqq 20)=u(16 \leqq k \leqq 20)$ and the following are true:

$$m_{dep}(k) \geq 0 \quad (45)$$

$$m_{cyl}(16 \leq k \leq 20) = \tau m_{dep}(15 \leq k \leq 19) + Xu(16 \leq k \leq 20) \quad (46)$$

$$R = \frac{1-X}{\tau} = \frac{m_{dep}(20)}{m_{cyl}(20)} \approx \frac{m_{dep}(20)}{\frac{1}{5}\sum_{k=16}^{20} m_{cyl}(k)} \quad (47)$$

$$R \approx \frac{\sum_{k=1}^{20} u(k) - \sum_{k=1}^{20} m_{cyl}(k)}{\frac{1}{5}\sum_{k=16}^{20} m_{cyl}(k)} \quad (48)$$

R is a measurement if CINJ is known. Using the relationship x=1−Rτ, one parameter is eliminated by replacing X in the following equation:

$$y(k)-(1-\tau)y(k-1)=Xu(k)-(X-\tau)u(k-1) \quad (49)$$

which provides:

$$u(k)-u(k-1)-y(k)+y(k-1)=\tau(y(k-1)-u(k-1)+R(u(k)-u(k-1))) \quad (50)$$

Because Equation 46 has one unknown parameter, the least squares algorithm can robustly identify the parameter τ even in the case of sparse data. In this manner, the model is calibrated using an inherent relationship among model parameters given sparse and noisy data. As a result, forcing mass conservation significantly reduces parameter variation in the calibration process with sparse and noisy data.

The calibration process of the present invention includes simultaneous optimization of the UFF function and the NFD function. The following test table exemplifies an exemplary minimal requirement to facilitate the calibration process for fuel control during the crank-to-run transition.

TABLE 1

| ECT | No. of Starts | Comments |
|---|---|---|
| −25 C. | ≧3 | 1. At least three good starts are needed at each ECT. |
| −20° C. | ≧3 | |
| −15° C. | ≧3 | 2. The number of tests shown represents what is required for the purpose of fuel dynamics identification only. |
| −10° C. | ≧3 | |
| −5° C. | ≧3 | |
| 0° C. | ≧3 | |
| 25° C. | ≧3 | |
| 90° C. | ≧3 | |

Table 1 is only an example of sampling schemes at different values of ECT. Variations on these can be used if the range of ECT is sufficiently well covered.

Figure 6:
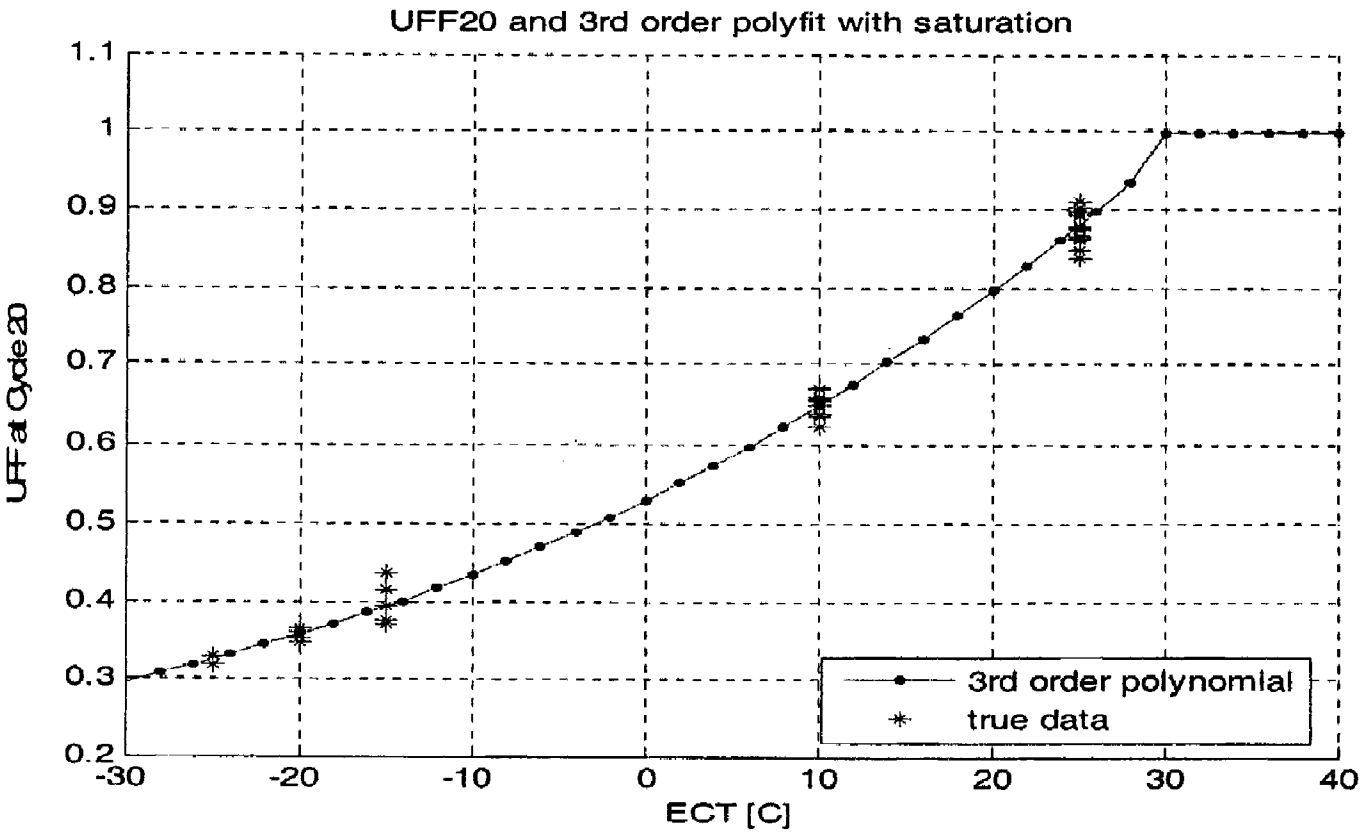
FIG. 6 is a graph illustrating a utilized fuel fraction (UFF) determined at an exemplary engine cycle for different engine coolant temperatures (ECTs) and a $3^{rd}$ order polynomial curve fit including a saturation limit.

Referring now to FIG. 6, calibration of $UFF_{20}$(ECT) will be described in detail. During the calibration of $UFF_{20}$ (ECT), averaged RINJ and MBFM measurements are taken from cycles 18 to 20 at each ECT. Only good starts are used in this calculation. $UFF_{20}$ is calculated for each test for the good starts. A third order polynomial to obtain a continuous (i.e., smooth) $UFF_{20}$(ECT) function via standard regression. A saturation limit, which is the maximum output of the regressed $UFF_{20}$ function, is set equal to 1. This occurs at higher ECTs as illustrated in the graph of FIG. 6.

Figure 7:
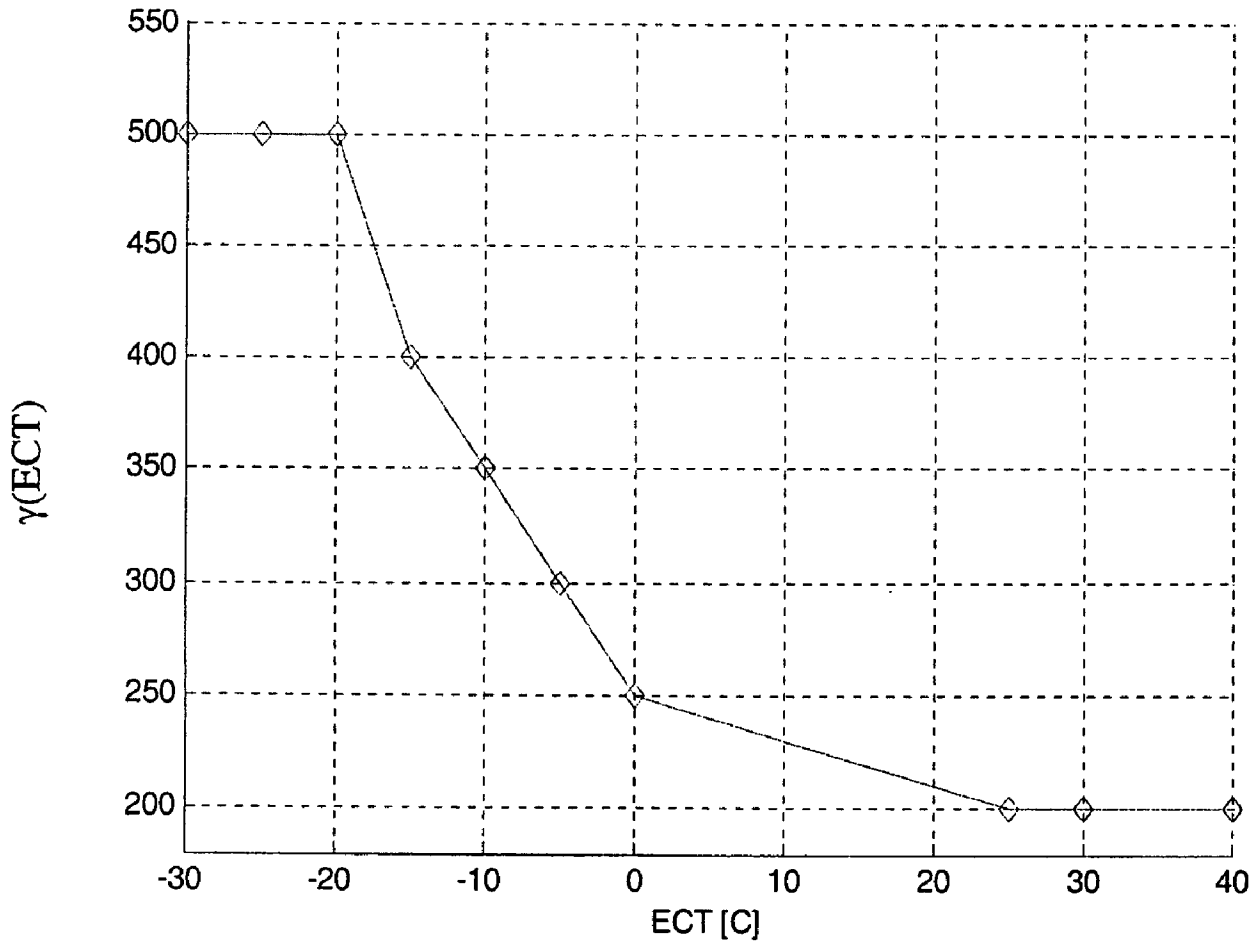
FIG. 7 is a graph illustrating the relationship between a shaping parameter function $\gamma$(ECT) and ECT that is used in the UFF function of the transitional fuel control.

Referring now to FIGS. 6 and 7, calibration of γ(ECT) and the NFD function at fixed ECT values will be described in detail. The effect of diminishing return (i.e., fuel delivered versus power generated from that fuel) occurs wherein the parameter γ(ECT)varies as a function of ECT. This effect becomes increasingly pronounced for lower ECTs, until the ECT drops below approximately −20° C., at which point γ(ECT) becomes constant. The only difference between the correction effects of the UFF function, for instance at temperatures below −20° C., results from the contribution of $UFF_{20}$(ECT). Further, when $UFF_{20}$(ECT) approaches 1, the diminishing return effect becomes negligible. As a result, the parameter γ(ECT) does not vary for temperatures beyond that value of ECT. This non-linear behavior of the UFF function is summarized in the exemplary graphs of FIGS. 6 and 7.

Figure 8:
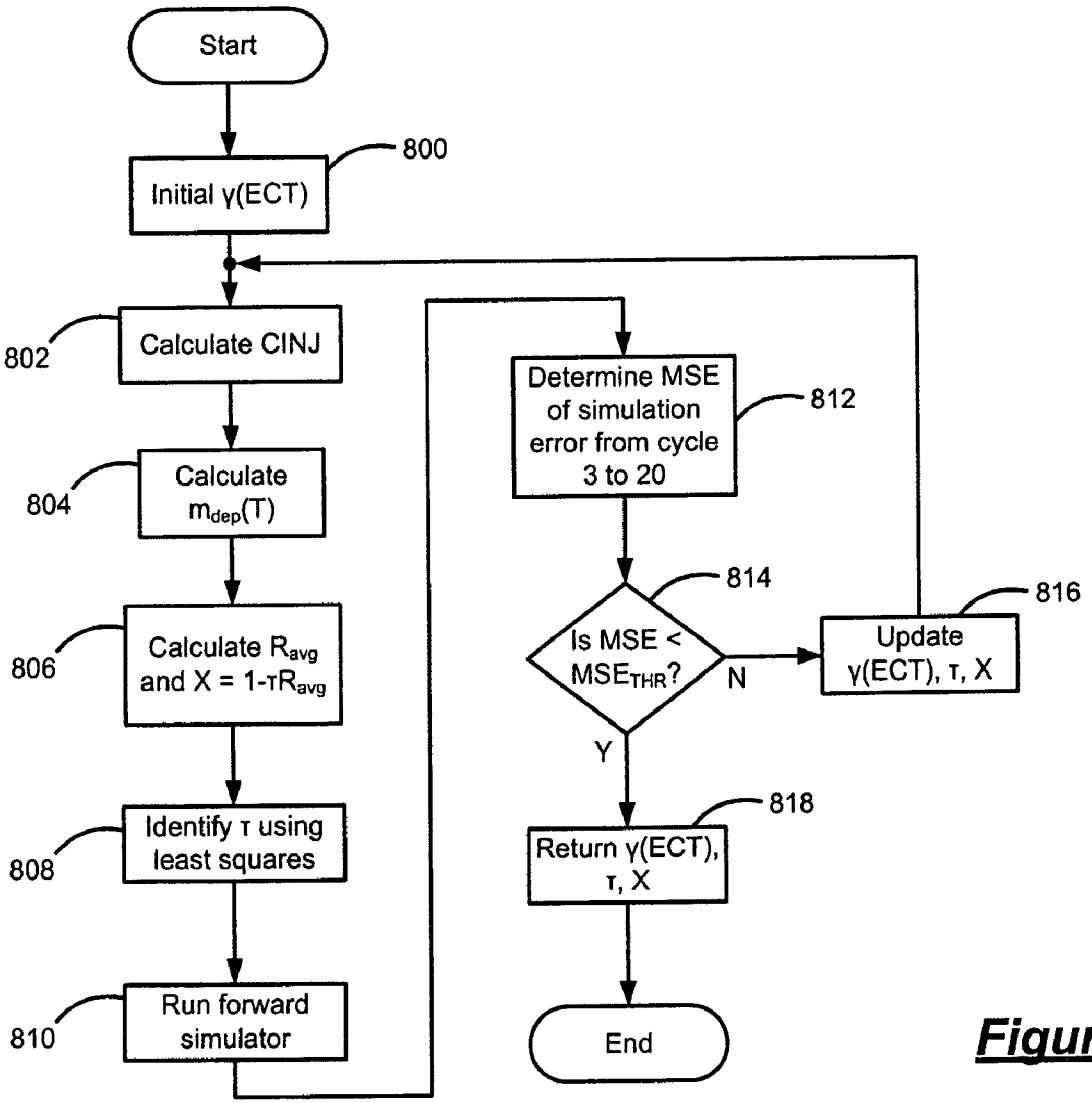
FIG. 8 is a flowchart illustrating exemplary steps to optimize $\gamma$(ECT) and the parameters of the NFD portion of the transitional fuel control.

Referring now to FIG. 8, a multi-step procedure for calibrating γ(ECT) and the NFD function will be described in detail. The multi-step procedure is an optimization routine. In step 800, optimization begins from a reasonable initial value for γ(ECT) at a given ECT. Examples of reasonable values for initial γ(ECT) are shown in the following table:

TABLE 2

| ECT | γ(ECT) |
|---|---|
| −25° C. | 500 |
| −20° C. | 450 |
| −10° C. | 400 |
| −5° C. | 350 |
| 0° C. | 300 |
| 10° C. | 250 |
| 25° C. | 200 |

In step 802, Equation 38 is used to calculate CINJ. $UFF_{20}$(ECT) is obtained from each individual test rather than from the regressed $UFF_{20}$(ECT) function discussed above. In step 804, Equation 44 is used to calculate the fuel storage ($m_{dep}$(T)), where Tis set to a desired value (e.g., 20).

In step 806, an averaged ratio ($R_{avg}$) is calculated based on the following equation:

$$R_{avg} = \frac{1}{n}\sum_{i=1}^{n} R \tag{51}$$

where n≧3 is the number of good start tests at a given ECT. In the ARMA representation of Equation 49, x is replaced with $x=1-R_{avg}\tau$ in step 806. In step 808, X is calculated based on τ according to the following equation:

$$X=1-R_{avg}\tau \tag{52}$$

and a basic least squares algorithm is implemented to determine r based on the reduced ARMA of Equation 50. The NFD function is simulated in the forward direction (i.e., non-inverted) based on CINJ and zero initial condition for y(k) in step 810.

In step 812, the simulated MBFM is obtained for cycles 1 through 20 the mean squared error (MSE) between the simulated MBFM and actual MBFM is determined from cycles 3 through 20. In step 814, it is determined whether MSE is less than a predetermined threshold ($MSE_{THR}$). If MSE is not less than $MSE_{THR}$, γ(ECT), τ and x are all updated in step 816 and control loops back to step 802. If MSE is less than $MSE_{THR}$, the values of γ(ECT), τ and x are returned in step 818 and optimization for the particular ECT ends. The optimization process is repeated for each ECT value.

The UFF correction requirement for RINJ at cycle 1 for each cylinder is different from cycle 2 and onward. Therefore, a free parameter at cycle 1 in the UFF function (UFF(1)) is specified and an optimization to identify the parameter is performed. UFF(1) is only applied for RINJ correction at cycle 1. Accordingly, the parameter UFF(1) is only used in the fuel dynamics control at Cycle 1 as well.

The following two equations summarize the above adjustment in the UFF function formulation:

$$CINJ(k=1) = UFF(1)RINJ(k=1) \tag{53}$$

$$CINJ(k>1) = UFF_{20}(ECT)\left(1-\frac{2}{\pi}\arctan\left(\frac{RINJ(k>1)}{\gamma(ECT)}\right)\right)RINJ(k>1) \tag{54}$$

It is further anticipated that a second scheme can be implemented to concurrently calibrate γ(ECT) and UFF. For control implementation, the choice of which calibration to use (i.e., between γ(ECT) or γ(ECT) and UFF) is made based on the worst case engine start scenario. For example, for inline-4 cylinder engines, the concurrent γ(ECT) and UFF scheme is preferred. For V-8 engines, because of larger inertia, the lone γ(ECT) is preferred because of reduced RPM fluctuations during poor starts.

A family of NFD models are generated using the procedure described above. A linear interpolation method is used to schedule the control module according to ECT values. More specifically, under normal engine starts, the parameters $\alpha_0$, $\alpha_1$ and $\beta_1$ are mildly influenced by RPM and MAP. However, under anomalous engine starts, inappropriate fuel dynamics compensation can result due to insufficient accuracy of MAP and RPM predictions. Therefore, the parameters $\alpha_0$, $\alpha_1$ and $\beta_1$ are functions of ECT alone. Based on the unit-gain property of the NFD, only two parameters (e.g., $\beta_1$ and $\alpha_0$) need be scheduled based on ECT. $\alpha_1$ is calculated based on $\beta_1$ and $\alpha_0$. The linear ECT scheduled NFD model is inverted to provide:

$$u(k) = -\frac{\alpha_1}{\alpha_0}u(k-1) + \frac{1}{\alpha_0}y(k) + \frac{\beta_1}{\alpha_0}y(k-1) \tag{55}$$

where y(k) is the desired in-cylinder burned fuel mass (i.e., CINJ).

Values of γ(ECT) obtained from the optimization routine described above are interpolated to form a continuous function across the range of ECTs. More specifically, a piecewise linear interpolation method is used to schedule γ(ECT). An example of scheduling based on a linear interpolation method is shown in the graph of FIG. 7.

Figure 9:
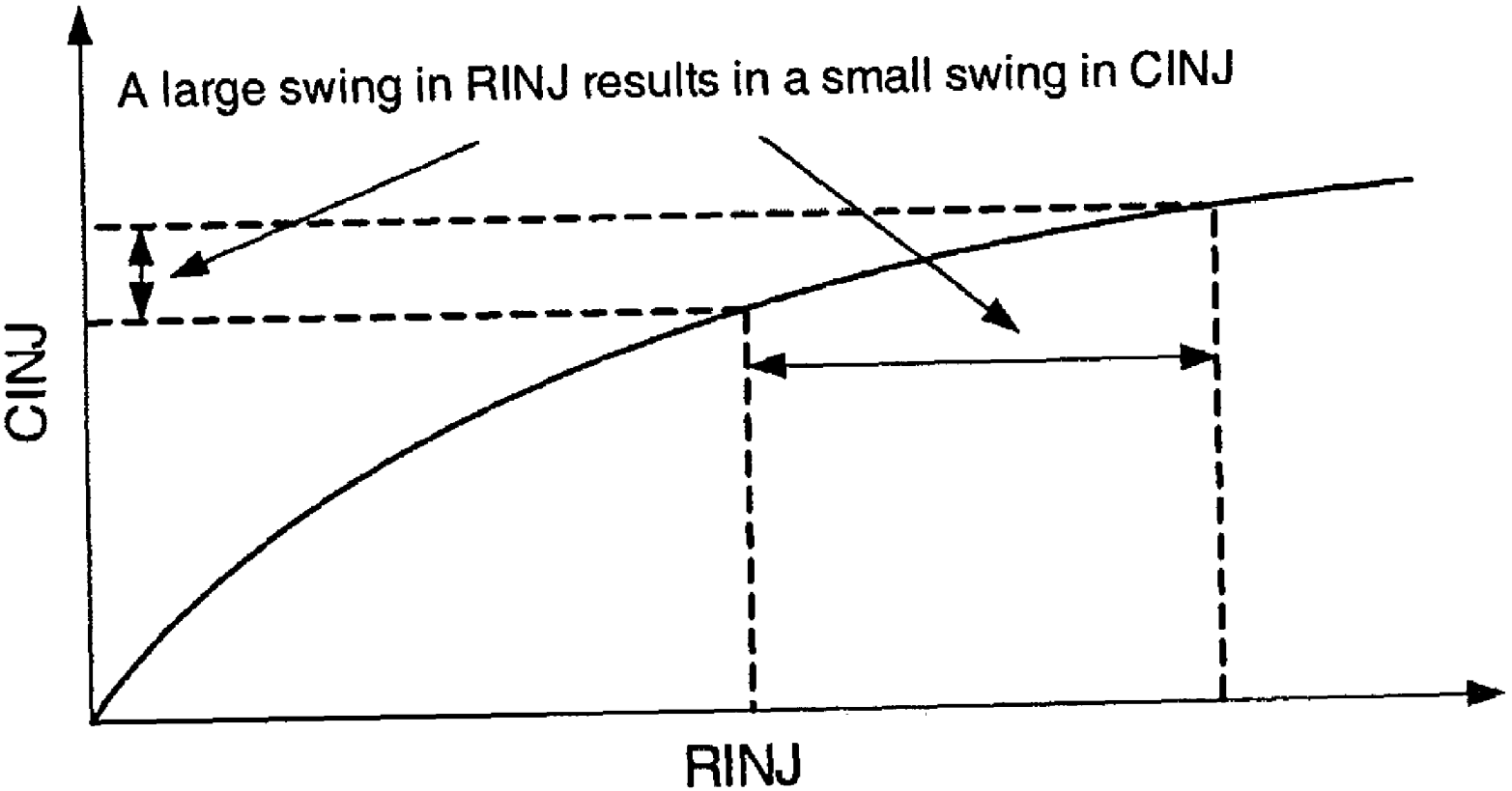
FIG. 9 is a graph illustrating the relationship between a raw injected fuel mass (RINJ) and a corrected injected fuel mass (CINJ) based on the UFF function of the transitional fuel control.

Referring now to FIG. 9, the basic characteristic of the forward (i.e., non-inverted) UFF function for a fixed ECT is illustrated. In addition to the diminishing return effect, there is an inherent saturation effect. More specifically, some values of CINJ may not include a corresponding RINJ within a reasonable range. The transitional fuel control, described above, inverts the UFF function. A linear splines technique is implemented to invert the forward UFF function and a new variable is defined as:

$$\text{CINJ_D_UFF}_{20}(k) = \frac{CINJ(k)}{UFF_{20}(ECT)} \tag{56}$$

The inversion problem of the forward UFF function reduces to the following equation:

$$\mathrm{CINJ_D_UFF}_{20}(k) = \left(1 - \frac{2}{\pi}\arctan\left(\frac{RINJ(k)}{\gamma(ECT)}\right)\right)RINJ(k) \tag{57}$$

The linear splines technique is applied to the Equation 57 and the following relationship can be obtained:

$$RINJ(k)=LSP(CINJ_D_UFF_{20}(k),ECT) \tag{58}$$

where LSP denotes approximation by linear splines.

A two-step procedure is used in the control calculation using the inverse UFF function approximated by linear splines. More specifically, after CINJ(k) is computed using the NFD function, the regressed $UFF_{20}$(ECT) function is used to calculate $\mathrm{CINJ_D_UFF}_{20}$(k) as follows:

$$\mathrm{CINJ_D_UFF}_{20}(k) = \frac{CINJ(k)}{UFF_{20}(ECT)} \tag{59}$$

Subsequently, the linear splines approximation for the inverse UFF function discussed above is used to obtain RINJ(k) as follows:

$$RINJ(k)=LSP(CINJ_D_UFF_{20}(k),ECT) \tag{60}$$

Figure 10:
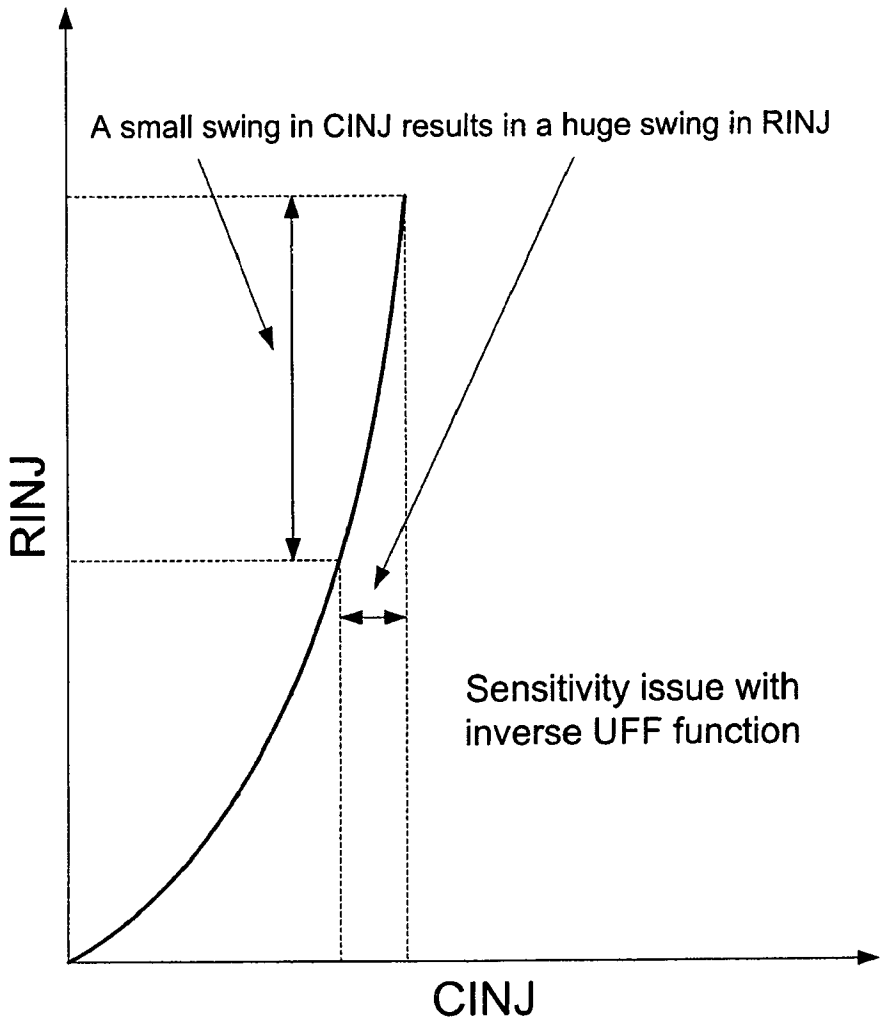
FIG. 10 is a graph illustrating the relationship between RINJ and CINJ based on the inverted UFF function of the transitional fuel control.
Figure 11:
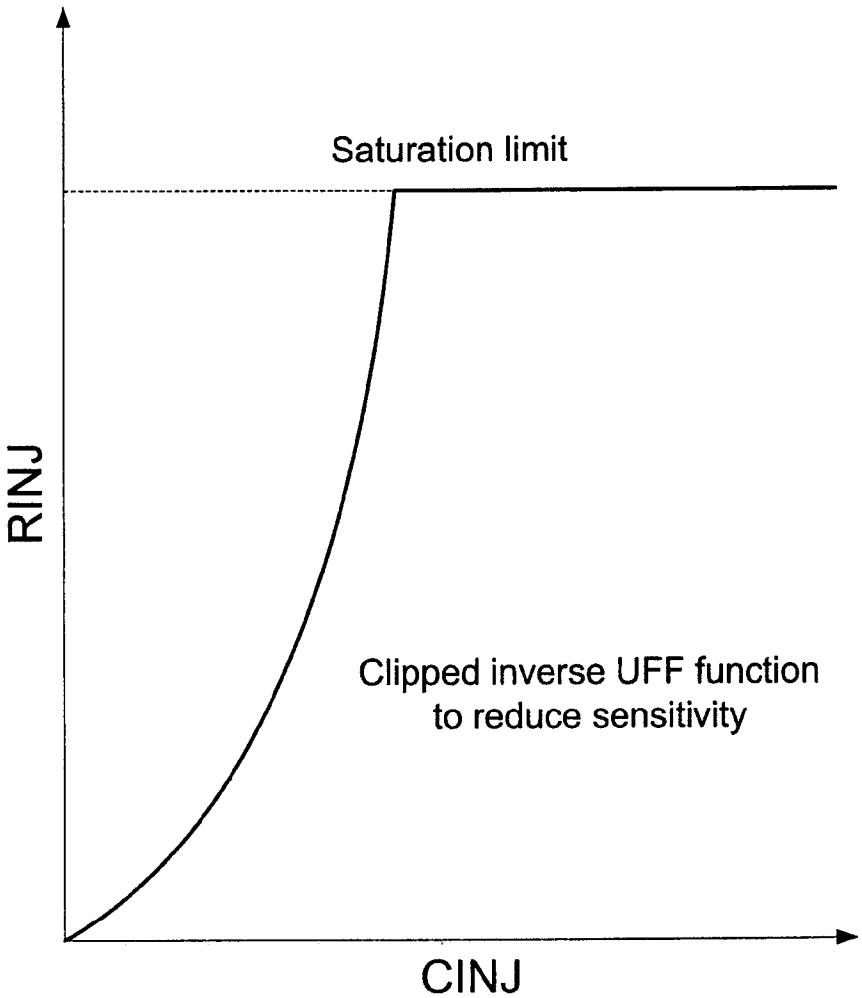
FIG. 11 is a graph illustrating the relationship between RINJ and CINJ including a saturation limit based on the inverted UFF function of the transitional fuel control.

Referring now to FIGS. 10 and 11, the inverse UFF function is viewed as a two-input, one-output static mapping that is approximated using the linear splines technique. Because the complete image of RINJ in the inverse UFF function approximation may not be attained when CINJ is sufficiently large, saturation limits on RINJ are introduced to realize a one-to-one mapping between CINJ and RINJ at each fixed ECT. This special treatment is depicted in FIGS. 10 and 11, where FIG. 10 summarizes the sensitivity effect and FIG. 11 indicates the implementation of a saturation limit. In addition to realizing a one-to-one mapping for the inverse UFF function approximation within a reasonable range of CINJ and RINJ, implementing a saturation limit reduces the sensitivity for fuel control in the case of poor engine start.

The saturation limit is determined by allowing RINJ(k) to increase such that $\mathrm{CINJ_D_UFF}_{20}$(k) is close to the saturation limit at each given γ(ECT), according to the following equation:

$$\mathrm{CINJ_D_UFF}_{20}(k) = \left(1 - \frac{2}{\pi}\arctan\left(\frac{RINJ(k)}{\gamma(ECT)}\right)\right)RINJ(k) \tag{61}$$

An example of a RINJ(k) value sufficient to reach the saturation limit is RINJ(k)=4×γECT), in which case the following is provided:

$$\begin{aligned}\mathrm{CINJ_D_UFF}_{20}(k) &\approx 4\left(1 - \frac{2}{\pi}\arctan(4)\right)\gamma(ECT)\\ &\approx 0.62\gamma(ECT)\end{aligned} \tag{62}$$

A value of RINJ(k) corresponding to 90% of $\mathrm{CINJ_D_UFF}_{20}$(k) is determined. For convenience, the corresponding values of RINJ(k) and $\mathrm{CINJ_D_UFF}_{20}$(k) are denoted here as $\mathrm{RINJ}^{90\%}$ and $\mathrm{CINJ_D_UFF}_{20}{}^{90\%}$, respectively. Data pairs are created such that when $\mathrm{CINJ_D_UFF}_{20}$(k)≧$\mathrm{CINJ_D_UFF}_{20}{}^{90\%}$, RINJ(k) is clipped at or otherwise limited to the value of $\mathrm{RINJ}^{90\%}$. The data pair is used to construct the linear splines approximation function of Equation 60 for different values of ECT.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A fuel control system for regulating fuel to cylinders of an internal combustion engine during an engine start and crank-to-run transition, comprising:

a first module that determines a raw injected fuel mass based on a utilized fuel fraction (UFF) model and a nominal fuel dynamics (NFD) model; and a second module that regulates fueling to a cylinder of said engine based on said raw injected fuel mass until a combustion event of said cylinder;

wherein each of said UFF and NFD models is calibrated based on data from a plurality of test starts that are based on a pre-defined test schedule.

2. The fuel control system of claim 1 wherein calibration of said UFF and NFD models occurs simultaneously.

3. The fuel control system of claim 1 wherein said third module determines an average raw injected fuel mass and an average measured burned fuel mass over a predefined number of engine cycles.

4. The fuel control system of claim 3 wherein said UFF model is calibrated based on said average raw injected fuel mass and said average measured burned fuel mass.

5. The fuel control system of claim 3 wherein said average raw injected fuel mass and said average measured burned fuel mass are determined at a plurality of engine coolant temperatures.

6. The fuel control system of claim 1 wherein said third module calibrates said NFD model and a shaping parameter at fixed engine coolant temperature intervals.

7. The fuel control system of claim 6 wherein said shaping parameter is calibrated based on an initial shaping parameter value, a corrected fuel mass, a UFF value and a raw injected fuel mass.

8. The fuel control system of claim 6 wherein said shaping parameter is calibrated based on a vaporization rate and an averaged ratio that is determined based on a corrected fuel mass and a measured burned fuel mass over a predefined number of engine cycles.

9. A method of calibrating models processed by a fuel control system that regulates fuel to cylinders of an internal combustion engine during an engine start and crank-to-run transition, comprising:

determining a raw injected fuel mass based on a utilized fuel fraction (UFF) model and a nominal fuel dynamics (NFD) model;

executing a predetermined number of engine starts based on a pre-defined test schedule;

regulating fueling to a cylinder of said engine during each of said engine starts based on said raw injected fuel mass until a combustion event of said cylinder, wherein each of said UFF and NFD models is calibrated based on data from said engine starts.

10. The method of claim 9 wherein calibration of said UFF and NFD models occurs simultaneously.

11. The method of claim 9 further comprising determining an average raw injected fuel mass and an average measured burned fuel mass over a predefined number of engine cycles of each of said engine starts.

12. The method of claim 11 wherein said UFF model is calibrated based on said average raw injected fuel mass and said average measured burned fuel mass.

13. The method of claim 11 wherein said average raw injected fuel mass and said average measured burned fuel mass are determined at a plurality of engine coolant temperatures.

14. The method of claim 9 further comprising calibrating said NFD model and a shaping parameter at fixed engine coolant temperature intervals.

15. The method of claim 14 wherein said shaping parameter is calibrated based on an initial shaping parameter value, a corrected fuel mass, a UFF value and a raw injected fuel mass.

16. The method of claim 14 wherein said shaping parameter is calibrated based on a vaporization rate and an averaged ratio that is determined based on a corrected fuel mass and a measured burned fuel mass over a predefined number of engine cycles.

17. A method of calibrating a fuel control system that regulates fuel to cylinders of an internal combustion engine during engine start transitions, comprising:

executing a predetermined number of engine starts at a plurality of engine coolant temperatures based on a pre-defined test schedule;

determining a raw injected fuel mass based on a utilized fuel fraction (UFF) model and a nominal fuel dynamics (NFD) model;

regulating fueling to a cylinder of said engine during each of said engine starts based on said raw injected fuel mass until a combustion event of said cylinder; and calibrating each of said UFF and NFD models is based on data from said engine starts.

18. The method of claim 17 wherein calibration of said UFF and NFD models occurs simultaneously.

19. The method of claim 17 further comprising determining an average raw injected fuel mass and an average measured burned fuel mass over a predefined number of engine cycles of each of said engine starts.

20. The method of claim 19 wherein said UFF model is calibrated based on said average raw injected fuel mass and said average measured burned fuel mass.

21. The method of claim 19 wherein said average raw injected fuel mass and said average measured burned fuel mass are determined based on each of said plurality of engine coolant temperatures.

22. The method of claim 17 further comprising calibrating said NFD model and a shaping parameter at fixed engine coolant temperature intervals.

23. The method of claim 22 wherein said shaping parameter is calibrated based on an initial shaping parameter value, a corrected fuel mass, a UFF value and a raw injected fuel mass.

24. The method of claim 22 wherein said shaping parameter is calibrated based on a vaporization rate and an averaged ratio that is determined based on a corrected fuel mass and a measured burned fuel mass over a predefined number of engine cycles.

* * * * *